US005095244A

United States Patent [19]

Maeda et al.

[11] Patent Number: 5,095,244

[45] Date of Patent: Mar. 10, 1992

[54] FLUORESCENT DISPLAY TUBE

[75] Inventors: Makoto Maeda; Masatake Hayashi, both of Tokyo, Japan

[73] Assignee: Sony Corporation, Tokyo, Japan

[21] Appl. No.: 445,654

[22] PCT Filed: Mar. 29, 1989

[86] PCT No.: PCT/JP89/00330

§ 371 Date: Nov. 29, 1989

§ 102(e) Date: Nov. 29, 1989

[87] PCT Pub. No.: WO89/09482

PCT Pub. Date: Oct. 5, 1989

[30] Foreign Application Priority Data

Mar. 29, 1988 [JP] Japan ..... 63-74935
Mar. 29, 1988 [JP] Japan ..... 63-74936
Mar. 29, 1988 [JP] Japan ..... 63-74937

[51] Int. Cl.[5] ..... H01J 1/96

[52] U.S. Cl. ..... 313/495; 313/497

[58] Field of Search ..... 313/495, 497

[56] References Cited

U.S. PATENT DOCUMENTS 4,608,518 8/1986 Fukuda et al. ..... 313/495 X
4,857,800 8/1989 Ohkoshi et al. ..... 313/497 X

FOREIGN PATENT DOCUMENTS 60-158779 8/1985 Japan .
61-135029 6/1986 Japan .

*Primary Examiner*—Sandra L. O'Shea
*Attorney, Agent, or Firm*—Hill, Van Santen, Steadman & Simpson

[57] ABSTRACT

The present invention relates to a fluorescent display tube suitable for use in a large screen display. The present invention enables the fluorescent segments R, G and B to be arranged at positions close to a peripheral side wall (13) of the tube (1) by, particularly, enlarging a range to which electron beams can impinge and eliminating the influence of electric field near the glass wall of the fluorescent display tube. Upon this, light emitting area can be increased to obtain bright display and distances between adjacent fluorescent segment R, G and B trios of adjacent fluorescent display tubes (1) and between adjacent trios in each fluorescent display tube (1) are made small to thereby shorten the arranging pitch of the fluorescent trios as a whole in a large screen display device, improving resolution.

3 Claims, 10 Drawing Sheets

FLUORESCENT DISPLAY TUBE

DESCRIPTION

1. Technical Field

The present invention relates to a fluorescent display tube and, particularly, to a fluorescent display tube adaptable to constitute a display device having a large size display screen with a plurality of the fluorescent display tubes by arranging them in horizontal and vertical directions.

2. Background Art

In order to provide a large size display screen, for example, a large size color display screen, a display device has been proposed, whose front view and side view are shown in FIGS. 1 and 2, respectively. As shown, the display device includes a plurality of fluorescent display tubes 1 arranged in rows and columns (i.e., in vertical direction Y and horizontal direction X), each fluorescent display tube having a fluorescent surface on which 16 fluorescent segment trios, each including, for example, red, green and blue fluorescent segments R, G and B, that is, 48 fluorescent segments R, G and B, are arranged in two lines (rows) and 8 columns to form a large size display screen, and provides a color image display on the large size display screen by selectively exciting the respective fluorescent segments thereon according to a display information.

In this case, an interval De between adjacent fluorescent segments, for example, trios of adjacent fluorescent display tubes 1 tends to be large due to the thickness of the peripheral wall and the thickness of the portion accommodating the lead wires 2 as shown in FIG. 2. Since, in order to perform a uniform display in a large display screen, an interval Ds between the fluorescent trios in each fluorescent display tube is also selected necessarily to be substantially the same as the interval De between the trios of adjacent fluorescent display tubes, it is desired to make the interval De between the trios in the adjacent display tubes as small as possible, in order to obtain a higher resolution on such large display screen. Therefore, it is required to arrange the fluorescent segment trios in the respective fluorescent display tubes as close to a glass wall surface of the tube horizontally as possible. When the fluorescent segments are arranged in the vicinity of the glass tube surface, an electron beam path directed thereto is necessarily close to the glass wall surface and thus the electron beam tends to be influenced by an unstable electric field produced by electric charges accumulated on the glass wall surface, i.e., insulating wall surface and, further, the possibility of collision of the electron beam with the wall surface is increased causing the unstability of electric field therearound to be increased.

This problem is enhanced for fluorescent segments located at outermost ends in a horizontal direction when the respective fluorescent segments take the form of vertically entending stripes.

In fluorescent display tubes used in such display device, since the respective fluorescent segments are fine, it is preferable, in view of simplicity of construction, to arrange a common line-shaped cathode to a plurality of fluorescent segments, for example, each trio of fluorescent segments. In such case, the line-shaped cathode is supported under tension by fixing both ends thereof to a stationary portion. Therefore, a temperature distribution on the cathode when it is heated exhibits high temperature around a center portion thereof and low temperature around the end portions due to heat dissipation in the connecting portions of the ends to the stationary portion, making electron emission density in the center portion large while that in the opposite end portions low. Consequently, even if a heating condition is set such that the temperature in the center portion of the cathode during operation reaches a value at which electron emission thereof is saturated, it does not become saturated at the opposite ends thereof, resulting in a difference in luminance of fluorescent segments at the center portion from those at the end portions. Further, in the opposite end portions which are easily influenced by current supply to the cathode (heater), luminance of the segments corresponding to the opposite end portions of the cathode is varied, resulting in difficulty of obtaining a white balance and/or an unstability thereof.

Further, in such fluorescent display tube, since there is a difference in light emitting efficiency among fluorescent materials for red, green and blue fluorescent segments R, G and B, a white balance is obtained by, for example, making the width of through-holes of respective grids G1–G3 for transmission of electron beams different from one another. Therefore, it is very difficult to obtain white balance by compensating for electron emission efficiency due to non-uniformity of temperature of the cathode K while keeping the width difference as it is.

Further, even if one cathode is provided for each segment, uniformity and stability of luminance in the segment is degraded for the same reason.

DISCLOSURE OF INVENTION

The present invention makes it possible to improve resolution of a large screen display device by enlarging the electron impinging area, by arranging fluorescent segments thereof in the vicinity of the peripheral wall, to thereby increase the light emissive area thereof and obtain a bright display and, further, by making the inter-trio interval De of adjacent fluorescent segments of adjacent fluorescent display tubes mentioned above and hence the inter-trio interval Ds small enough to thereby minimize the arranging pitch of fluorescent trio in the large screen display device as a whole.

Further, the present invention makes it possible to arrange fluorescent segments as close to the peripheral wall of the container as possible by avoiding influence of electric field around a glass wall surface on electron beam. With such arrangement, the inter-trio interval of the fluorescent segments is made small enough and thus resolution of the large screen display device is improved.

Further, the present invention is intended to improve uniformity of light emission in the segments and improve and stabilize white balance by obtaining substantially uniform current density throughout the length of the cathode.

BEST MODE FOR CARRYING OUT THE INVENTION

A first embodiment of the present invention will be described with reference to FIGS. 3–10.

Figure 3:
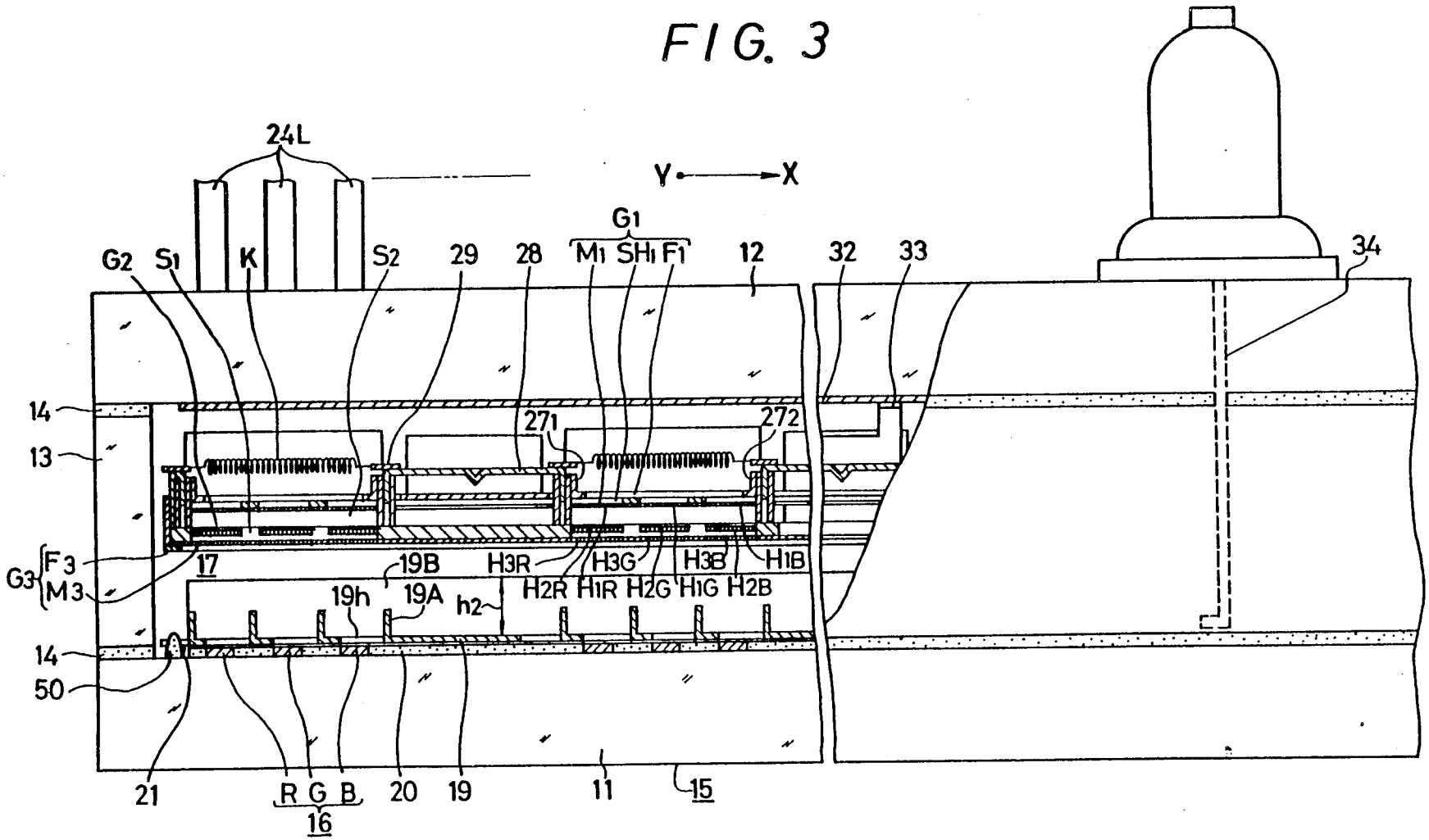
FIG. 3 is a cross sectional side view of a main portion of a fluorescent display tube according to the present invention.
Figure 4:
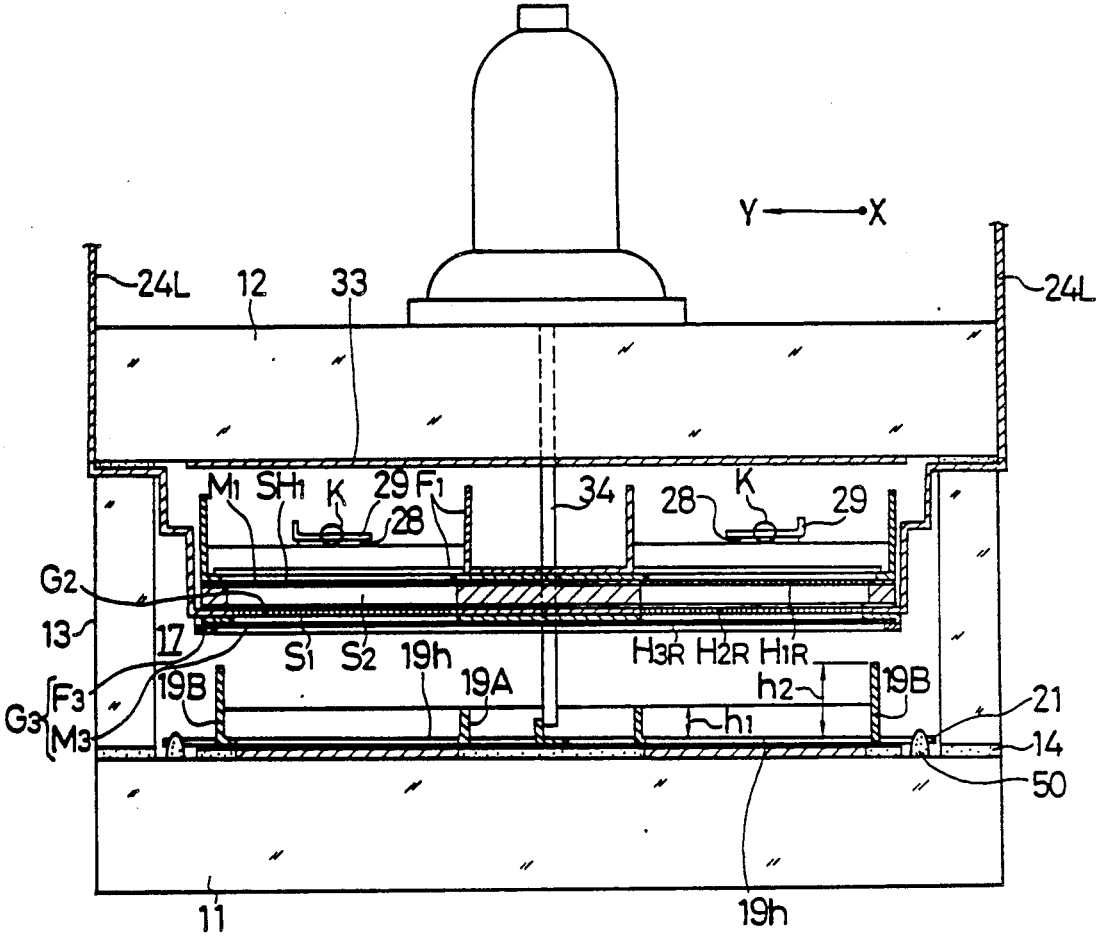
FIG. 4 is a cross section thereof in an orthogonal direction thereto.
Figure 5:
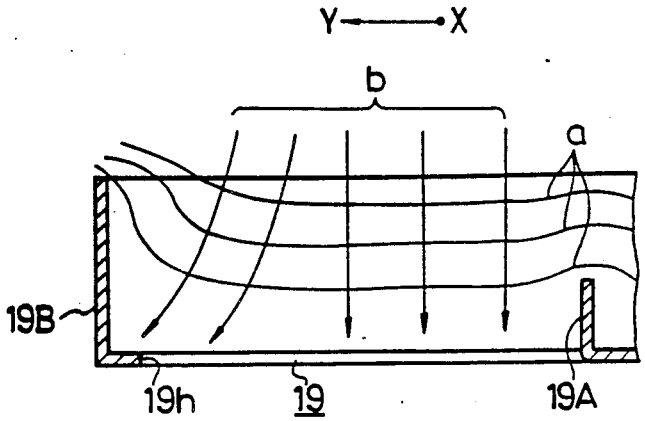
FIG. 5 shows a potential distribution.

In the present invention, as shown in FIG. 3 which shows a cross section of a main portion in a horizontal X direction and in a thickness direction of a tube and in FIG. 4 which shows a cross section thereof in a vertical Y direction and in the thickness direction of the tube, there is a flat type container 15, i.e., a tube, defined by a light transmissive first panel 11, a second panel 12 opposing to the panel and a peripheral wall 13, interior of which is kept in high vacuum. The first and second panels 11 and 12 are formed from rectangular glass panels, respectively, the glass peripheral wall 13 constitutes four side walls between the glass panels 11 and 12, all three being sealed with glass frit 14 to form the flat type container 15.

A fluorescent plane 16 is provided on an inner surface of the first panel 11, which is formed by arranging fluorescent segments, for example, red, green and blue fluorescent segments R, G and B. The fluorescent plane 16 is formed by arranging a plurality of, for example, 2 rows and 8 columns of fluorescent trios, each being composed of red, green and blue fluorescent segments R, G and B, that is, 48 segments. Between the respective segments R, G and B, a light absorbing layer 20 of such as carbon coating layer, etc., is provided, and a metal back layer (not shown) of such as Al vapor-deposition membrane or the like is formed to cover a whole fluorescent plane.

And, an electron beam control mechanism 17 is provided in opposing relation to the fluorescent plane 16 for directing an electron beam to the respective fluorescent segments R, G and B. Between the electron beam control mechanism 17 and the fluorescent plane 16, a separator electrode 19 is arranged, which includes partition walls 19A for partitioning spaces in front of the respective fluorescent segments R, G and B to avoid mutual interference of electron beams related to the respective fluorescent segments R, G and B.

The separator electrode 19 includes a protruded wall 19B which protrudes from portion of the partition wall 19A in position in which the fluorescent segments R, G and B are to be arranged at least in the vicinity of the peripheral wall 13, i.e., along two sides of the peripheral wall extending in horizontal X directions. The protruded wall 19B has a height h2 which is higher than height h2 of other members. The separator electrode 19 has, as shown in, for example, FIG. 8, the respective partition walls 19A having height h1 and the protruded wall 19B having height h2 higher than h1 formed by punching and bending up of a metal plate. The separator electrode 19 has, as shown in FIG. 3, a mounting piece 21 protruding from the peripheral wall which is fixed by, for example, glass frit 50 to the panel 11 and supported thereby.

Figure 6:
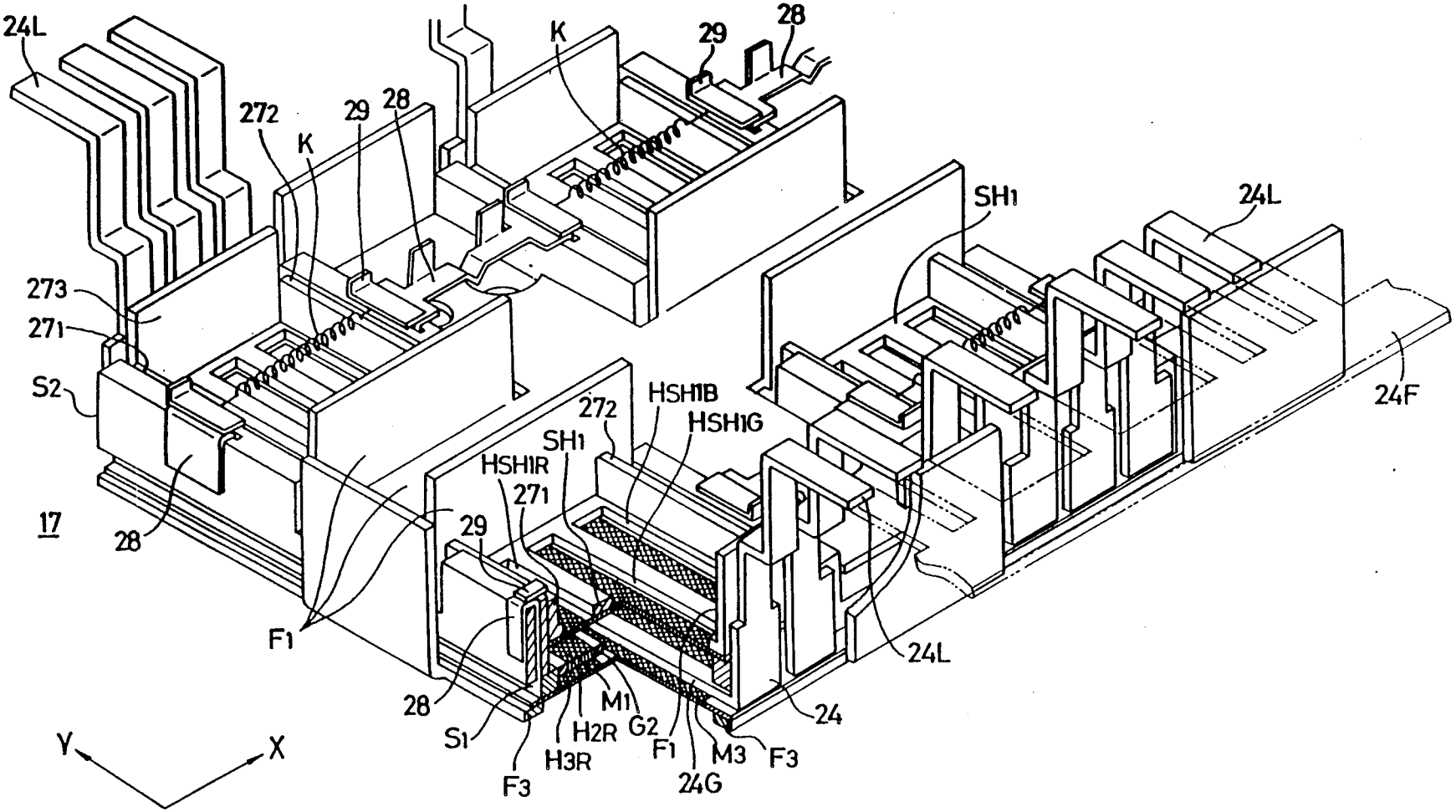
FIG. 6 is a cross sectional perspective view of a main portion of an electron beam control mechanism thereof.
Figure 7:
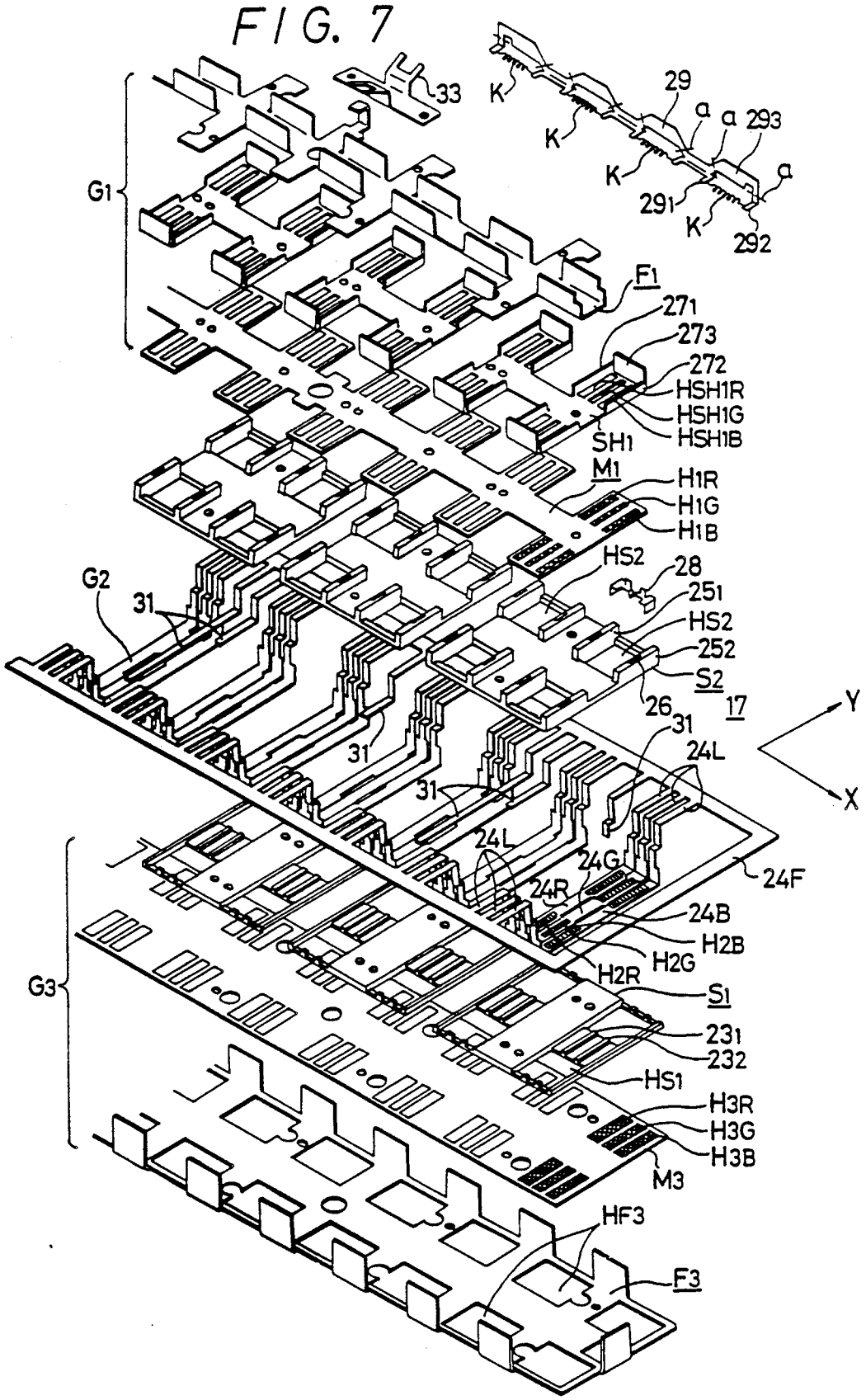
FIG. 7 is a disassembled perspective view of the electron beam control mechanism.

The electron beam control mechanism 17 provided in opposing relation to the fluorescent plane 16 has, as shown by a partially removed main portion in FIG. 6 and by a disassembled perspective view thereof in FIG. 7, a construction in which the cathode K, a first grid G1, a second grid G2 and a third grid G3 are arranged in a plane in the order toward the side of the fluorescent plane 16.

The third grid G3 is composed of a lamination of a third grid frame F3 made of, for example, a metal plate and a third grid main body M3 made of a thin metal plate. The frame F3 has through-holes H each being common a trio of the red, green and blue fluorescent segments R, G and B of the fluorescent plane 16. Further, the third grid main body M3 is formed with mesh type through-hole $H_{3R}$, $H_{3G}$ and $H_{3B}$ by photolithography correspondingly in position to the through-hole $H_{F3}$ of the frame F3 in opposing relation to the respective fluorescent segments R, G and B. The third grid main body M3 is mounted on the third grid frame F3 such that the through-holes $H_{3R}$, $H_{3G}$ and $H_{3B}$ thereof coincide with the through-holes $H_{F3}$ of the frame F3 and, on the third grid main body, a first insulating spacer S1 made of such as ceramic or the like which is common to, for example, adjacent four sets of trios arranged in 2 rows is mounted. The first insulating spacer S1 has through-holes $H_{S1}$ corresponding to the respective through-holes $H_{F3}$ of the frame F3 and two protrusions $23_1$ and $23_2$ extend vertically in Y direction between the through-holes $H_{S1}$ (in the shown example, paired through-holes) on a common column, that is, in a vertical direction Y.

And, on the third grid main body M3, the second grid G2 is arranged through the respective spacers S1. The second grid G2 has strip type parallel electrodes 24R, 24G and 24B commonly to a common column of the respective mesh type through-holes $H_{3R}$, $H_{3G}$ and $H_{3B}$ of the third grid main body M3 and the respective strip shaped electrodes 24R, 24G and 24B are formed by photolithography, etc., with paired mesh type through-holes $H_{2R}$, $H_{2G}$ and $H_{2B}$ corresponding to the paired through-holes $H_{3R}$, $H_{3G}$ and $H_{3B}$ on a common column in Y direction of the frame M3. Opposite ends of the strip electrodes 24R, 24G and 24B become leads 24L, respectively, and they are connected at their outer ends by a frame portion 24F to form a lead frame before assembling. This lead frame is formed by photolithography, etc. This lead frame is mounted on the third grid G3 through the respective spacers S1 such that the protrusions $23_1$ and $23_2$ of the spacers S1 become in between the respective strip electrodes 24R, 24G and 24B and the frame portion 24F is removed after assembling of the electron beam control mechanism 17 to electrically separate the respective electrodes 24R, 24G and 24B.

And, on the lead frame of the second grid G2, the first grid G1 is mounted through a second insulating spacer S2 which is made of an insulating material such as ceramic or the like and serves also as a cathode support, in the similar manner.

The second insulating spacer S2 is arranged, in the similar manner to the first insulating spacer S1, commonly to, for example, adjacent four fluorescent trios arranged in two rows and two columns and has through-holes $H_{S2}$ corresponding to the respective through-holes $H_{F3}$ of the frame F3 of the third grid G3. On both sides of the respective through-holes $H_{S2}$, paired protrusions $25_1$ and $25_2$ which are integral with the spacer are provided on both sides of the respective through-holes $H_{S2}$ in the vertical Y direction and the respective protrusions $25_1$ and $25_2$ are formed with a cathode support fitting portion 26 comprising a through-hole or groove open at an end face of the cathode K.

The first grid G1 is formed by laminating a first grid main body M1, a shield plate $S_{H1}$ and a first grid frame F1 in the order. The first grid main body M1 has, for example, mesh type through-holes $H_{1R}$, $H_{1G}$ and $H_{1B}$ formed by, for example, photolithography opposing to the respective mesh type through-hole $H_{3R}$, $H_{3G}$ and $H_{3B}$ and $H_{2R}$, $H_{2G}$ and $H_{2B}$ of the third grid G3 and the second grid G2. The shield plate $SH_1$ of the first grid G1 is common to four trios each including, for example, mesh type through-hole $H_{1R}$, $H_{1G}$ and $H_{1B}$, that is, adjacent four trios arranged in two rows and two columns and is formed by punching and bending, for example, a metal plate, and the respective shield plates $S_{H1}$ are formed with side walls $27_1$ and $27_2$ at positions opposing to the mesh type through-hole $H_{1R}$, $H_{1G}$ and $H_{1B}$ of the first grid main body M1 and extending in a vertical direction Y on both sides of a horizontal X direction of the trio of through-hole $H_{SH1R}$, $H_{SH1G}$ and $H_{SH1B}$ by bending up the metal plate and side walls $27_3$ are also formed similarly between outer ends by bending up. The frame F1 of the first grid can be similarly formed by punching and bending a metal plate commonly to a plurality of shield plates $S_{H1}$.

The first grid main body M1, the shield plate $S_{H1}$ and the frame F1 constituting the first grid G1 are mounted sequentially on the second insulating spacer S2 such that the protrusions $25_1$ and $25_2$ of the spacer S2 protrude between the trios of the respective through-holes. And, metal pieces 28 for mounting the cathode are inserted into the respective fitting portions 26 of the respective protrusions $25_1$ and $25_2$ of the spacer S2 such that they ride on across the end faces of the protrusions $25_1$ and $25_2$ of other through-holes $H_{S2}$ of adjacent ones.

On the other hand, the cathode K takes in the form of, for example, cathode material affixed by, for example, spraying it on a sprial heater extending, for example, linearly and has opposite ends directly welded to the metal pieces 28 or the cathode can be formed, as shown in FIG. 7, by preliminarly extending the cathode heater tightly on, for example, a cathode support member 29 and after sprayed with cathode material welding the metal pieces 28 to the opposite ends of the cathode heater and then cutting the cathode holder 29 at a position such as shown by, for example, a chain line a between the opposite ends of the respective cathodes K to perform electrical separation between the ends.

The frame F3, the third grid main body M3 and the first insulating spacer S1 constituting the third grid G3, the lead frame F2 and the second insulating spacer S2 constituting the second grid G2, the first grid main body M1, and the shield plate $S_{H1}$ and the frame F1 constituting the first grid G1 are stacked in the order described above and cauked together with metal grommets (not shown) through the respective through-holes thereof. In this case, the insertion holes of the first grid G1 and the third grid G3 for the grommets for cauking are made larger in size alternately so that there is no electric connection provided by the metal grommets between the respective grids G1–G3.

The electron beam control mechanism 17 formed by integrating the cathode K and the first—third grids G1–G3 as a unit is supported mechanically by leading out the lead 24L of the second grid G2 through the frit portion between the panel 12 and the peripheral wall 13 and the lead is derived externally of the container 15.

Incidentally, in this case, as shown in FIG. 7, the lead frame F2 constituting the second grid G2 is provided in the frame portion 24F with a lead 31 connecting to a terminal of the cathode K or the third and first grids G3 and G1 and welded to the electrodes G1, G3 corresponding thereto or the cathode holder 29 or the metal piece 28 in assembling the electron beam control mechanism 17 and derived, together with the leads 24L, through the frit portion of the container 15 as shown in FIG. 3.

Further, on an inner surface of the second panel 12, a rear surface electrode 32 is formed by, for example, carbon coating layer, etc., and is electrically connected to the first grid G1 by a resilient contact of a metal resilient piece 33 mounted on, for example, the first grid G1.

On the other hand, for example, a high voltage lead 34 penetrates, for example, a center portion of the flat type container 15, whose inner end is electrically connected to the separator electrode 19 to derive a terminal.

With the construction mentioned above, a high voltage, for example, 5 KV is applied through the high voltage lead 34 to the fluorescent plane 16 and the separator electrode 19. Further, a voltage, for example, 10 V is applied through the lead 31 to the first grid G1 and the rear surface electrode 32 and a low potential, for example, 0 V is applied to the third grid G3. To the second grid G2, a voltage is selectively applied through the lead 24L which is 15 V when it is in ON state and −2 V when it is in OFF state. By modulating respective electron beams toward the respective fluorescent segments R, G and B by means of this ON, OFF switching of voltage to the strip electrodes 24R, 24G and 24B of the second grid G2 and selection of voltage applied to the cathode K, the respective fluorescent segments emit light in, for example, line sequence.

Figure 1:
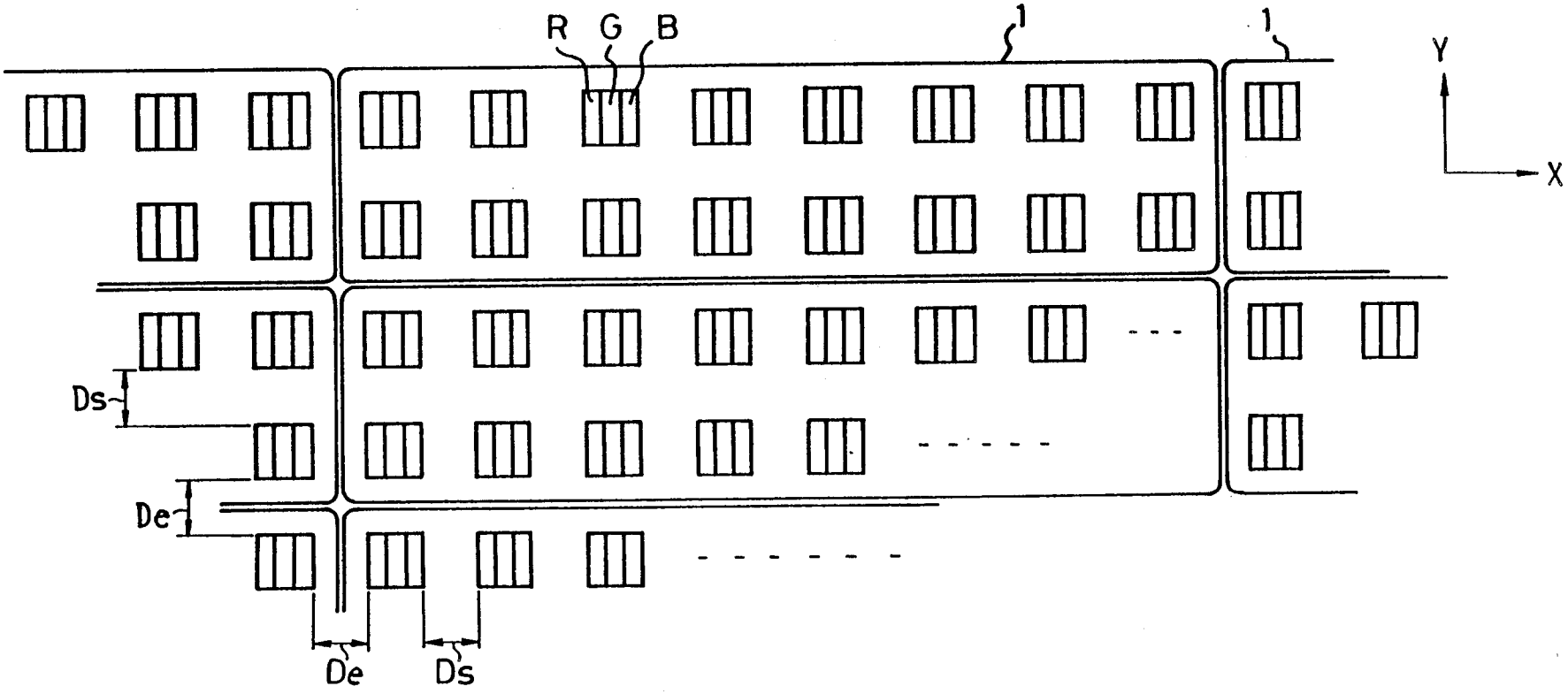
FIG. 1 is a front view of a large screen display device.
Figure 2:
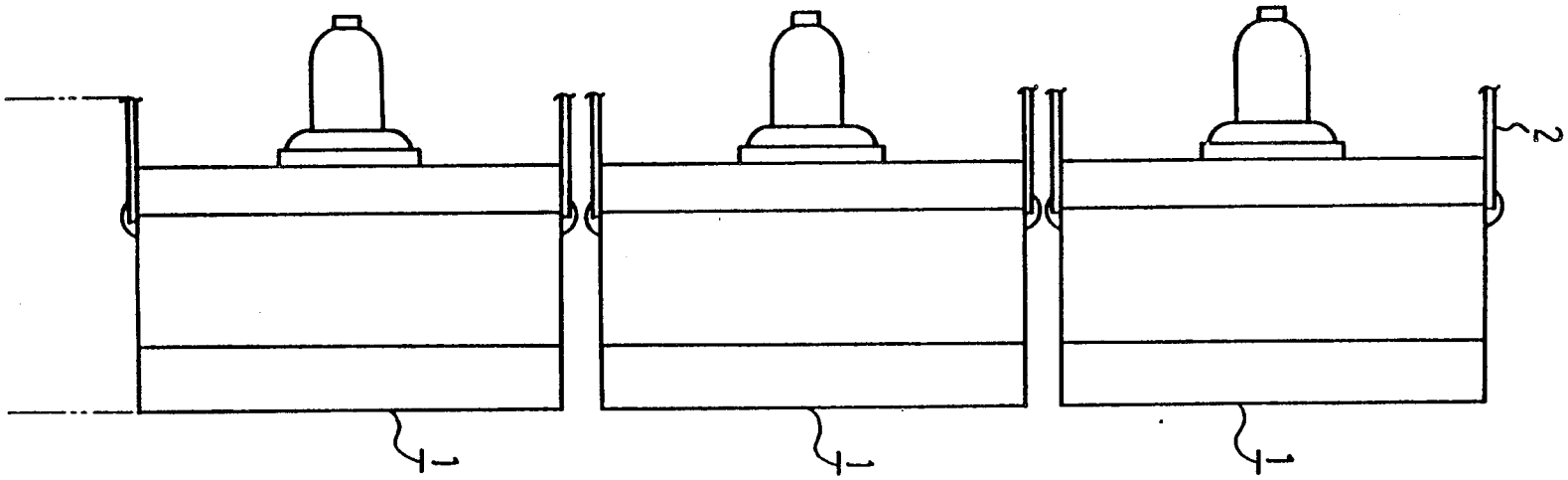
FIG. 2 is a side view thereof.

The fluorescent display tube according to the present invention mentioned above can perform a color display on a large screen by arranging a number of such tubes in a flat plane as mentioned with respect to FIGS. 1 and 2.

In the construction mentioned above, a low potential, for example, 0 V is applied to the electrode on the fluorescent plane side of the electron beam control mechanism 17, for example, the third gird G3. By applying an anode voltage, that is, a fluorescent plane voltage which is a high voltage of, for example, 5 KV to the separator electrode 19, equipotential lines in front of the separator electrode 19 are bent relatively remarkably in the vicinity of the protruded side wall 19B of the separator electrode 19 as shown schematically by thin line a in FIG. 5 and electron beam b entering into this portion is deflected outwardly, that is, toward the protruded side wall 19B with respect to, for example, the vertical Y direction. That is, the range of possible electron beam impingement toward the first panel 11 is enlarged. That is, the separator electrode 19 is usually to avoid mutual interference of electron beams toward the respective fluorescent segments R, G and B and the respective electron beams move substantially straight in the emitting direction from the electron beam control mechanism 17 toward the respective fluorescent segments R, G and B without being considerably deflected by the separator electrode 19. In the construction of the present invention mentioned above, in a portion of a peripheral portion opposing the peripheral wall 13, in which there is the protruded side wall 13 whose height h2 is higher than height h1 of other portions, beam diverges toward the side of the peripheral wall 13.

Thus, in the electron beam path to which the protruded side wall 19B faces, electron beam is deflected toward the side of the protruded side wall 19B to which the high voltage is applied to thereby diverge the electron beam. Therefore, it is possible to arrange the fluorescent segments in positions very close to the peripheral wall 13. Therefore, as described with reference to FIG. 1, in a case where a large screen display device is constructed by arranging a plurality of adjacent fluorescent display tubes 1, the interval De between the adjacent fluorescent segments (trios) and hence the interval Ds can be small enough, resulting in a high resolution.

Figure 9:
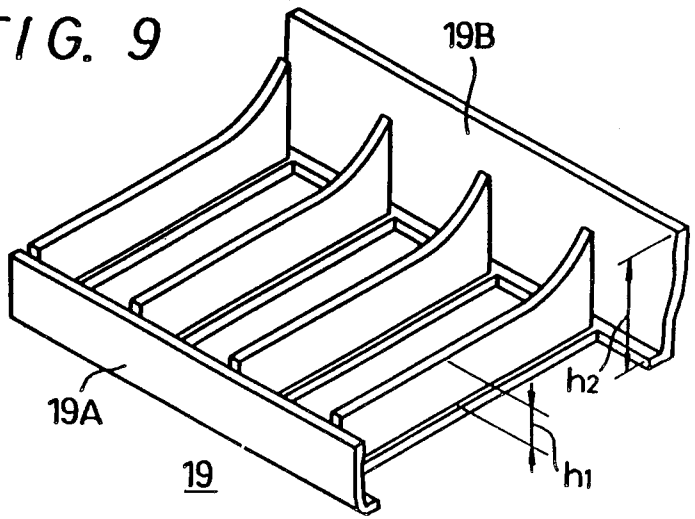
FIGS. 8–10 are perspective views of a main portion of a separator electrode.
Figure 8:
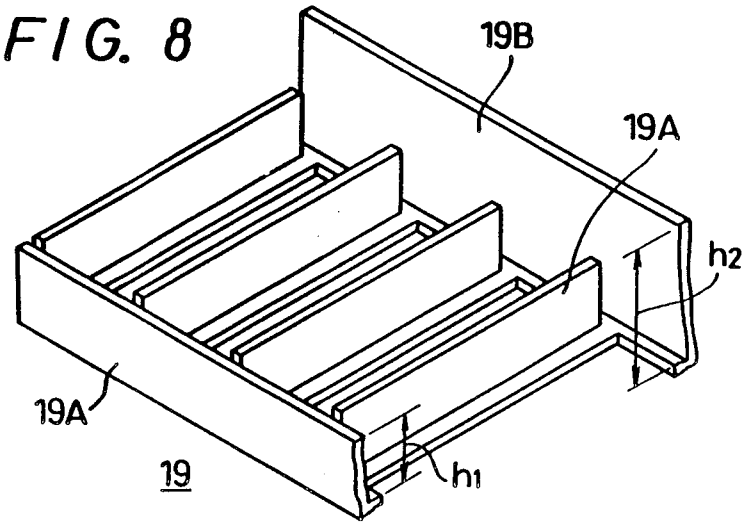
Figure 10:
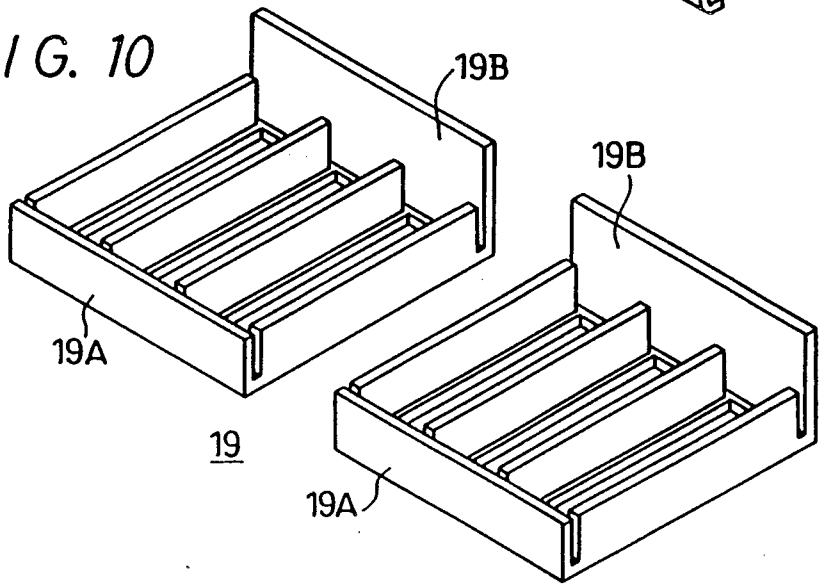

The separator electrode 19 is not limited to the example shown in FIG. 8 mentioned above, it is possible to use a construction in which the height is gradually changed from the protruded side wall 19B having height h2 to the partition wall 19A having height h1 as shown in FIG. 9. Further, although, in the examples shown in FIGS. 8 and 9, a set of separator electrodes 19 common for the fluorescent segments on the respective lines, it is possible to provide a set of separator electrodes 19 for each trio as shown in FIG. 10 or to provide a set of separator electrodes 19 for a plurality of trios.

Further, although, in the above mentioned example, the shortening of the interval De is performed by enlarging the electron beam impinging range in only the vertical direction Y, it is possible to obtain a similar construction in the horizontal X direction by combining it with means for varying a segment pitch of the electrode portion.

Further, although, in the above described example in which the present invention is applied to a color display, the respective fluorescent segments are formed by red, green and blue fluorescent segments R, G and B, the present invention can be applied to monochromatic or various color display.

Further, although, in the example mentioned above, the flat type container 15 is formed by the first and second panels 11 and 12 and the peripheral wall 13 all of which are welded by frit, it can be modified in various manners, for example, by constituting the peripheral wall 13 and, for example, the first panel 11 as a unit.

Figure 11:
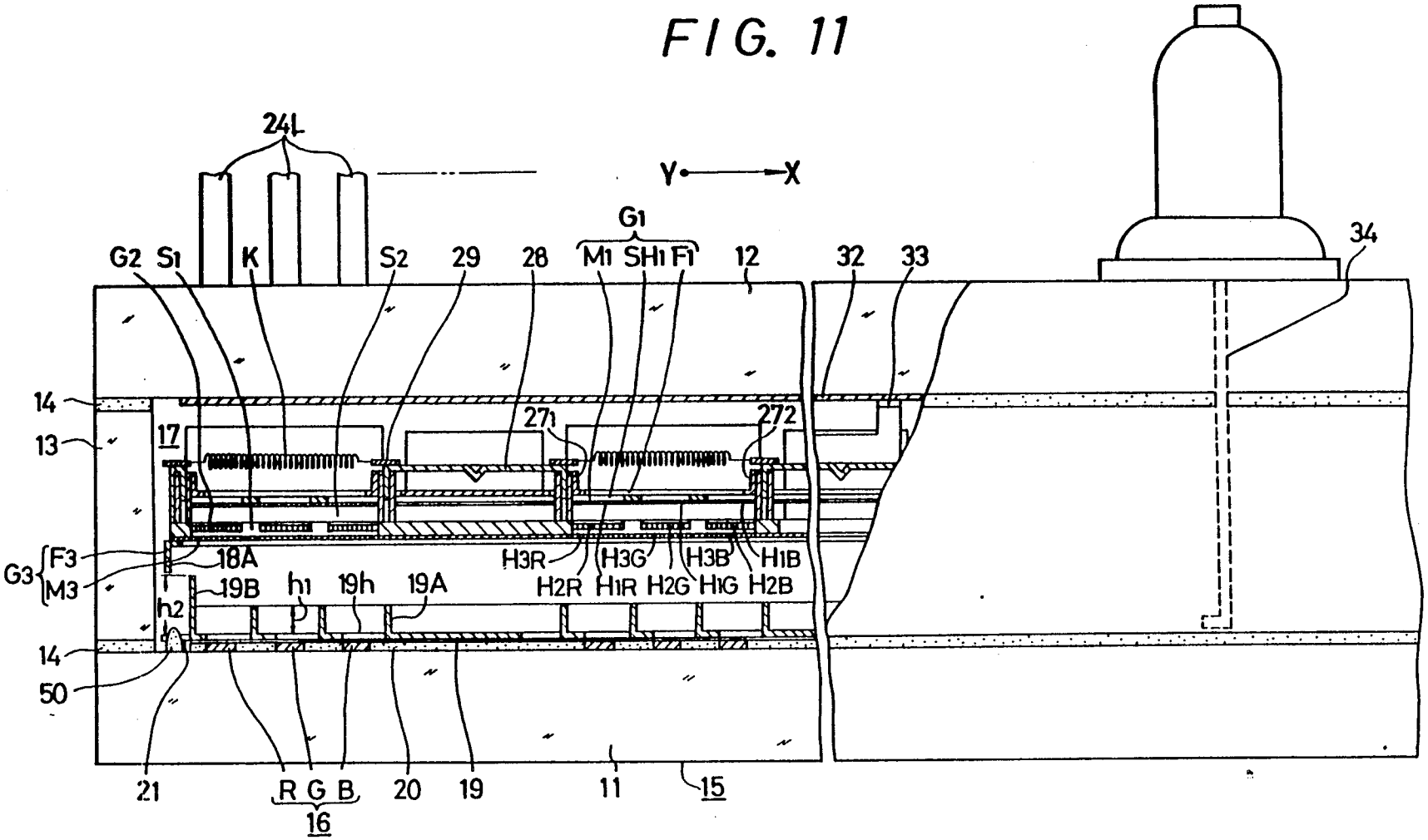
FIG. 11 is a cross sectional side view of a main portion of a fluorescent display tube according to the present invention.
Figure 14:
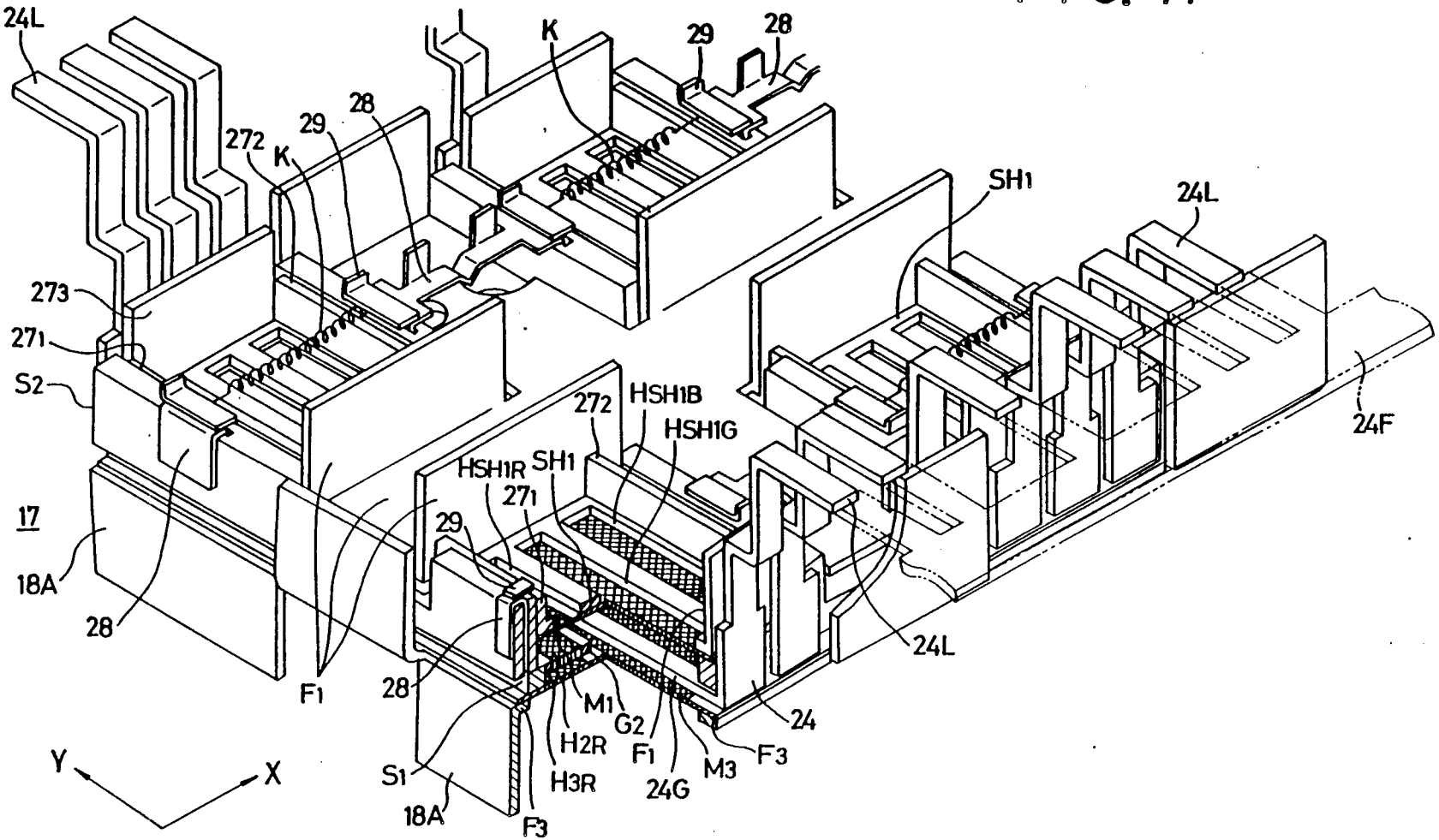
FIG. 14 is a cross sectional perspective view of a main portion of an electron beam control mechanism of a fluorescent display tube according to the present invention.

A second embodiment will be described. As shown in FIG. 11, a main portion of a fluorescent display tube is similar to that of the first embodiment. Therefore, duplication of explanation will be avoided. In the second embodiment, in a portion of a partition wall 19A of a separator electrode 19, in which fluorescent segments R, G and B are to be arranged in the vicinity of at least a peripheral side wall 13, a protruded side wall 19B whose height is larger than the partition wall 19A in other portions is provided. Such portion is opposed to the peripheral side wall 13, along a vertical direction Y. As shown in FIG. 11 and in FIG. 14, showing a partly cut-away perspective view, a low voltage electrode (in the shown example, a third grid G3) has a protruded side wall 18A extending along the peripheral side wall 13 toward the separator electrode 19.

Figure 12:
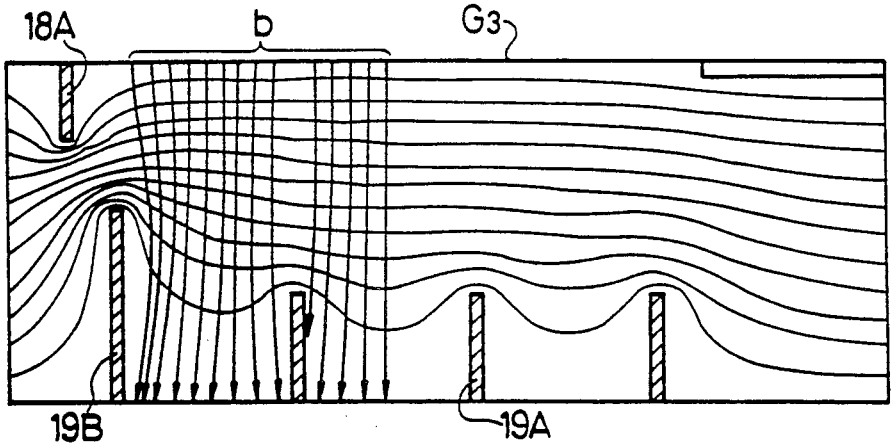
FIG. 12 shows a potential distribution of the main portion of the fluorescent display tube according to the present invention.
Figure 13:
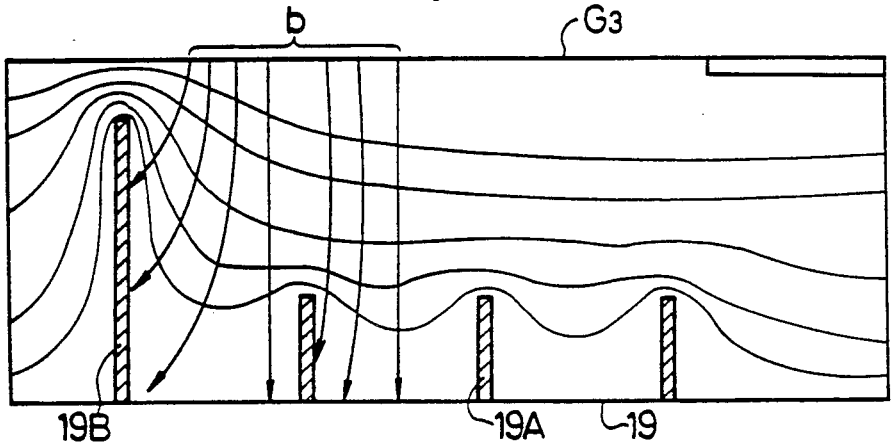
FIG. 13 shows a potential distribution of a main portion of a comparative example.

In this case, with the provision of the separator electrode 19 connected to an anode voltage, that is, a fluorescent plane voltage which is a high voltage of, for example, 5 KV, and with the provision of the protruded side walls 19B and 18A extending from the separator electrode 19 and the low voltage electrode G3 near the respective peripheral side walls 13, an influence of electric field on electron beam path due to the peripheral side wall 13 is avoided. Thus, a distortion of electron beam path can be avoided. That is, in a case, for example, where it is desired to cut such influence of the peripheral side wall 13 by only the protruded side wall 19b protruding from the separator electrode 19 to which a high voltage is applied, the equipotential line in the vicinity of the protruded side wall 19B is sharply bent as shown in FIG. 13, so that the electron beam b is deflected outwardly, that is, toward the protruded side wall 19B, resulting in a disadvantage that it impinges thereon. According to the present invention in which the protruded side wall 18A to which a low voltage is applied from the low voltage electrode, for example, the third grid G3 is provided, so that the electron beam b is subjected to an inward deflection thereby as shown in FIG. 12 and it is possible to cancel a the deflection due to the protruded side wall 19B to which a high voltage is applied. Therefore, electron beam b can move substantially straight.

As described, according to the present invention, it is possible to remove an influence of an unstable charge accumulation on a glass plane due to the peripheral side wall 13 of the container 15 on electron beam path and to avoid an undesirable electron beam deflection by providing the protruded side walls 19B and 18A on the high voltage separator electrode 19 and the low voltage electrode G3 in the fluorescent tube. Therefore, it is possible to narrow the interval De mentioned with respect to FIG. 1 and thereby make the interval Ds smaller between adjacent segment trios of each fluorescent display tube. Thus, in a case of a large screen display, resolution is improved and color deviation, etc., due to unstable deflection of electron beam is avoided, resulting in an image projection with high image quality.

Although, in the described example, the protruded side walls 19B and 18A are provided on both sides of the horizontal direction X, that is, along the vertical direction Y, it is possible to take similar construction with respect to side surfaces in other directions.

A third embodiment will be described. As shown in FIGS. 3 and 11, a first grid G1 among a group of grids which opposes the cathodes is formed with opposing side walls $27_1$ and $27_2$ extending toward opposite end portions of extensions of the respective cathodes K, such that they protrude on the cathode K side in orthogonal directions to the extensions of the cathodes K.

Figure 15:
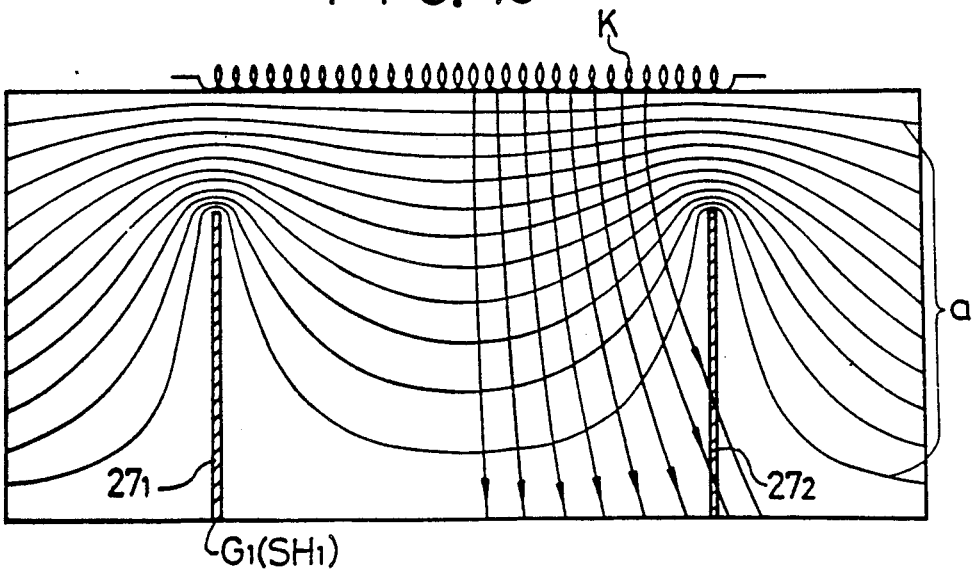
FIG. 15 is a potential distribution in a direction along the cross section in FIG. 3.

In such construction, a low voltage of, for example, 0 V is applied to electrodes on a fluorescent plane side of an electron beam control mechanism 17, for example, a third grid G3, and an anode voltage, that is, a fluorescent plane voltage which is a high voltage of, for example, 5 KV is applied to a separator electrode 19 and a voltage of, for example, 10 V is applied to the first grid G1. Due to the side walls $27_1$ and $27_2$ of the first grid G1 which are at the opposite ends of the cathode K, an electric field which acts to diverge electron beam outward is produced in front of the cathode K as shown by a thin line a in FIG. 15. Therefore, an electron beam emitted from a center of the cathode K is deflected outwardly, so that electron density in the center is reduced while in the opposite end portions it is condensed. Therefore, a low emission density due to low temperature at the opposite end portions of the cathode K is compensated by a current density distribution. That is, it is possible to obtain a substantially uniform current density throughout the length of the cathode K and, therefore, it is possible to improve the uniformity of light emission in the segments, improve white balance and stabilize the operation. That is, in a large screen display, it is possible to project stably an image with a good white balance.

We claim:

1. A fluorescent display tube, comprising a flat type container having opposing first and second panels and a peripheral side wall, a fluorescent plane formed by arranging fluorescent segments on an inner surface of said first panel, an electron beam control mechanism provided in opposing relation to said fluorescent plane for directing electron beams to said respective fluorescent segments, and a separator electrode arranged between said fluorescent plane and said electron beam control mechanism and having a wall partitioning a front space between said fluorescent segments, characterized in that a protruded side wall is provided at a portion of said separator electrode adjacent to said peripheral side wall in a portion of said container in which said fluorescent segments are to be disposed in proximity to said peripheral side wall, said protruded side wall being in spaced parallel relation to said peripheral side wall and having a height extending toward said second panel which is higher than the height of other portions of said separator electrode.

2. A fluorescent display tube comprising a flat container having opposing first and second panels and a peripheral side wall, a fluorescent plane formed by arranging fluorescent segments on an inner surface of said first panel, an electron beam control mechanism provided in opposing relation to said fluorescent plane for directing electron beams to said fluorescent segments, and a separator electrode arranged between said fluorescent plane and said electron beam control mechanism and having a wall partitioning a front space between said fluorescent segments, characterized in that a protruded side wall is provided at a portion of said separator electrode adjacent to said peripheral side wall in at least a portion of said container in which said fluorescent segments are to be disposed in proximity of said peripheral side wall, said protruded side wall extending along said peripheral side wall toward said electron beam control mechanism and having a height in a dimension parallel to said side wall higher than the height of other portions of said separator electrode, and a protruded side wall is provided on a low voltage electrode of said electron beam control mechanism, said protruded side wall of said low voltage electrode extending along said peripheral side wall toward said separator electrode, and extending in the direction toward said separator electrode by a greater distance than any other portion of said low voltage electrode.

3. A fluorescent display tube, characterized by the combination comprising a flat container having opposing first and second panels and a peripheral side wall, a fluorescent plane formed by arranging fluorescent segments on an inner surface of said first panel, an electron beam control mechanism having cathodes and at least one grid provided in opposing relation to said fluorescent plane for directing electron beams to said fluorescent segments, each of said cathodes comprising an elongate linear cathode provided for at least one of said fluorescent segments, and a side wall provided on said grid, said side wall extending away from said first panel toward an end portion of at least one of said linear cathodes.

* * * * *